US005735063A

United States Patent [19]

Mc Manus

[11] Patent Number: 5,735,063

[45] Date of Patent: Apr. 7, 1998

[54] SKISHOES WITH BRAKES AND EXTENSION AND RETRACTION STOPS THEREFOR

[76] Inventor: John H. Mc Manus, 1758 Indian Way, Oakland, Calif. 94611

[21] Appl. No.: 664,419

[22] Filed: Jun. 14, 1996

Related U.S. Application Data

[63] Continuation-in-part of Ser. No. 275,640, Jul. 15, 1994, Pat. No. 5,553,403.

[51] Int. Cl.[6] ..... A43B 5/04; A63C 13/00; A63C 5/00

[52] U.S. Cl. ..... 36/124; 36/122; 280/600; 280/605

[58] Field of Search ..... 36/122, 123, 124, 36/125; 280/600, 604, 605

[56] References Cited

U.S. PATENT DOCUMENTS

| | | | |
|---|---|---|---|
| 476,572 | 6/1892 | Stone . | |
| 3,118,157 | 1/1964 | Houser | 9/310 |
| 3,269,037 | 8/1966 | Massicotte | 36/4.5 |
| 3,798,801 | 3/1974 | Gros-Louis | 36/2.5 |
| 3,861,698 | 1/1975 | Greig | 280/11.13 |
| 3,927,896 | 12/1975 | Detoia | 280/11.13 |
| 3,965,585 | 6/1976 | Stewart | 36/125 |
| 4,085,529 | 4/1978 | Merrifield | 36/125 |
| 4,259,793 | 4/1981 | Morgan, Jr. | 36/125 |
| 4,280,715 | 7/1981 | Freelander | 280/623 |
| 4,327,504 | 5/1982 | Welsch | 36/122 |
| 4,334,369 | 6/1982 | Brunel | 36/124 |
| 4,652,006 | 3/1987 | Desoutter | 280/604 |
| 4,724,626 | 2/1988 | Baggio | 36/117.8 |
| 4,873,774 | 10/1989 | Lafever | 36/61 |
| 5,014,450 | 5/1991 | McGrath | 36/124 |
| 5,253,437 | 10/1993 | Klebahn et al. | 36/122 |

FOREIGN PATENT DOCUMENTS

| | | |
|---|---|---|
| 0142263 | 2/1935 | Austria . |
| 0542885 | 7/1957 | Canada . |
| 1247018 | 10/1960 | France . |
| 2409066 | 7/1979 | France . |
| 3003503 | 9/1980 | Germany . |
| 0144867 | 11/1980 | Germany . |
| 3205233 | 8/1983 | Germany . |
| 0433183 | 4/1948 | Italy . |
| 0005721 | 4/1997 | Norway . |
| 0029869 | 1/1910 | Sweden . |
| 0294725 | 11/1953 | Switzerland . |
| 0473231 | 10/1937 | United Kingdom . |

*Primary Examiner*—Ted Kavanaugh
*Attorney, Agent, or Firm*—Schapp and Hatch; Rankin A. Milliken

[57] ABSTRACT

A skishoe having a central, downwardly concave arch portion, an upwardly concave toe portion, an upwardly concave heel portion, and a snow gripping blade. The snow gripping blade is pivotable about an axis lying within the camber of the arch portion and extending transversely of the skishoe. A first adjustable stop is provided for limiting the angular deflection of the gripper blade from its fully retracted position in the camber. A second adjustable blade stop is provided for limiting the retraction of the blade into the camber, and a spring is provided for resiliently biasing the blade toward the first adjustable blade stop. Electric drive motors are provided for selectively positioning said stops. Manually operated control means, attached to the body of the user, are provided for controlling said electric drive motors.

10 Claims, 7 Drawing Sheets

SKISHOES WITH BRAKES AND EXTENSION AND RETRACTION STOPS THEREFOR

This application is a continuation-in-part of application Ser. No. 08/275,640 filed on Jul. 15, 1994 now U.S. Pat. No. 5,553,403.

BACKGROUND OF THE INVENTION

1. Field of the Invention

My present invention relates to winter sports equipment, and more particularly to devices of the kind sometimes called skishoes, which combine certain aspects of skis with certain aspects of snowshoes and thus are adapted to permit the user thereof to transverse substantially horizontal or upwardly sloping terrain by walking, much as one may do with snowshoes, and yet to slide forwardly over downwardly sloping terrain, much as one may do with skis.

2. Description of the Prior Art

Various types of skishoes are known in the prior art.

U.S. Pat. No. 3,861,698, issued to James W. Greig on Jan. 21, 1975, discloses a combination snowshoe and ski which comprises a hollow light-weight plastic envelope which is longitudinally corrugated along its upper portion and along its bottom portion, exhibits transversely extending wedge-shaped corrugations which allow the snowshoe ski to slide forwardly but resist rearward movement, with the longitudinal and transverse corrugations being connected together to rigidify the snowshoe ski and with a foot binding on the upper portion adapted to retain the snowshoe ski on a variety of sizes of footwear.

U.S. Pat. No. 3,927,896, issued to Vincent D. Detoia on Dec. 23, 1975, discloses an attachable device which may be mounted on a ski so as to permit the ski to serve either as a snowshoe or a ski. The device incorporates an assembly of cleats that are retractably mounted over slots fitted in the ski such that the cleats may be pressed into a first position in which they project below the bottom surface of the attached ski or into a second position in which they rest flush with the bottom surface of the ski.

U.S. Pat. No. 4,334,369, issued to Paul H. Brunel on Jun. 15, 1982, discloses a ski-shoe for traveling on snow which has an elongated generally flat baseplate having an upwardly curved front end and a pair of longitudinally extending side edges. Respective upright sides extending the full length of the baseplate have lower edges joined to the side edges of the baseplate. A pair of side rails extending outwardly and downwardly from the upper edges of the sides and having lower edges lying above the baseplate form downwardly open channels with the respective sides. The foot of the user is secured to the baseplate between its front and rear ends and between the sides. At least one flap is pivotal underneath the baseplate between an axis lying ahead of the flap between and upper position lying generally against the baseplate and a down position extending transversely downwardly from the baseplate. The sides, rails, and baseplate all are made integrally of a synthetic resin and the device has an overall length of less than one meter.

The term "prior art" as used herein or in any statement made by or on behalf of applicant means only that any document or thing referred to as prior art bears, directly or inferentially, a date which is earlier than the effective filing date hereof.

Additional prior art is listed in the Information Disclosure Statement filed herewith.

No representation or admission is made that any of the patents listed in the accompanying Information Disclosure Statement is part of the prior art, or that a search has been made, or that no more pertinent information exists.

A copy of each of the patents referred to hereinabove is supplied to the United States Patent and Trademark Office herewith.

SUMMARY OF THE INVENTION

Accordingly, it is an object of my present invention to provide novel skishoes which can efficiently and effectively function as snowshoes when the user thereof is traversing snow-covered, substantially horizontal terrain.

Another object of my present invention to provide novel skishoes which achieve the above object and also can function efficiently and effectively as snowshoes when the user thereof is traversing snow-covered terrain which is upwardly sloped in the user's direction of travel.

Another object of my present invention to provide novel skishoes which achieve the above objects and also can function more efficiently and effectively than conventional snowshoes when the user thereof is traversing snow-covered terrain which is upwardly sloped in the user's direction of travel.

Yet another object of my present invention is to provide novel skishoes which achieve one or more of the above objects and can also function as skis when the user thereof is traversing snow-covered terrain which is downwardly sloped in the user's direction of travel.

A further object of my present invention is to provide novel skishoes which achieve one or more of the above objects and which comprise snow gripping means, grippers, or brakes which grip the underlying snow and thus provide reaction force when the user thereof is traversing snow-covered terrain which is substantially horizontal or is upwardly sloped in the user's direction of travel.

A yet further object of my present invention is to provide novel skishoes which achieve the immediately preceding object and the grippers or brakes of which are automatically retractable by pressure exerted by the underlying snow when the user thereof is traversing snow-covered terrain which is downwardly sloped in the user's direction of travel.

An additional object of my present invention is to provide novel skishoes which attain one or more of the above objects and the effect of the grippers or brakes of which in horizontal or upwardly inclined travel is manually adjustable by the user thereof.

Another object of my present invention is to provide novel skishoes which attain one or more of the above objects and the effect of the grippers of which in downwardly inclined travel is manually adjustable by the user thereof.

Yet another object of my present invention is to provide skishoes which attain one or more of the above objects and the minimum effect of the grippers of which in downward travel is manually settable by the user thereof.

A further object of my present invention is to provide skishoes which attain one or more of the above objects and the range of effectiveness of the grippers or brakes of which is manually settable by the user thereof.

A yet further object of my present invention is to provide skishoes which attain one or more of the above objects and the angle of the grippers or brakes of which with respect to the body thereof can be set by the user thereof in accordance with weight of the user and the depth of the snow covering the terrain over which the user thereof expects to travel.

An additional object of my present invention is to provide skishoes the grippers of which automatically change from uphill configuration to downhill configuration when the slope of the terrain being crossed by the user changes from uphill to downhill.

Another object of my present invention is to provide skishoes which attain one or more of the above objects and which are adapted to both downhill skiing and downhill walking.

Yet another object of my present invention is to provide skishoes which attain one or more of the above objects, and the grippers of which are alternatively adjustable by the user thereof for either downhill skiing or downhill walking.

Another object of my present invention is to provide skishoes which attain one or more of the above objects and the grippers of which can be locked by the user thereof at any desired angle with respect to the body thereof over a wide range of such angles.

Another object of my present invention is to provide skishoes which attain one or more of the above objects and the bodies of which are shaped in the manner of conventional bearpaw snowshoes to impart optimal weight bearing properties in the snowshoe mode.

Another object of my present invention is to provide skishoes which attain one or more of the above objects and the bodies of which are elongated, with straight or slightly incurved sides to operate optimally in the ski mode.

An additional object of my present invention is to provide novel skishoes which attain one or more of the above objects and the effect of the grippers or brakes of which in horizontal or upwardly inclined travel is electrically adjustable by the user thereof while the user remains upright on the skishoes.

Another object of my present invention is to provide novel skishoes which attain one or more of the above objects and the effect of the grippers or brakes of which in downwardly included travel is electrically adjustable by the user thereof while the user remains upright on the skishoes.

Yet another object of my present invention is to provide skishoes which attain one or more of the above objects and the minimum effect of the grippers or brakes of which in downward travel is electrically settable by the user thereof while the user remains upright on the skishoes.

A further object of my present invention is to provide skishoes which attain one or more of the above objects and the range of effectiveness of the grippers or brakes of which is electrically settable by the user thereof while the user remains upright on the skishoes.

A further object of my present invention is to provide skishoes which achieve one or more of the above objects and at the same time include novel shoe bindings which are simple in structure, light in weight, easy to use and adapted to bind virtually any skiboot or shoe.

A yet further object of my present invention is to provide skishoes which achieve one or more of the above objects and which are provided with the boot clamps of certain well known belt-and-clamp combinations.

Other objects of the invention will in part be obvious and will in part appear hereinafter.

My present invention, accordingly, comprises the features of construction, combinations of elements, and arrangements of parts which will be exemplified in the constructions hereinafter set forth, and the scope of my present invention will be indicated in the claims appended hereto.

In accordance with another principal feature of my present invention a skishoe is comprised of a body member which is elongated in the intended direction of travel of the skishoe and has a central arch portion which defines a downwardly concave camber and snow engaging gripper blade means which is pivotably mounted for pivoting about a pivot axis which extends transversely of said camber and is substantially parallel to the wall thereof.

In accordance with yet another principal feature of my present invention biasing means is provided for resiliently biasing said gripper blade means away from its fully retracted position in said camber.

In accordance with yet another principal feature of my present invention first adjustable stop means is provided for limiting the deflection of said gripper blade means from its fully retracted position in said camber.

In accordance with a further principal feature of my present invention first adjustable stop means is provided for limiting the movement of said gripper blade means toward said fully retracted position.

In accordance with a yet another principal feature of my present invention said adjustable stop means are individually manually adjustable by means of manually operable adjustment control means which are accessible to the user of the skishoe of my present invention while mounted thereupon.

In accordance with another principal feature of my present invention said adjustable stop means are individually electrically adjustable under the control of manually operable adjustment control means which are accessible to the user of a pair of skishoes of my present invention while standing thereupon.

In accordance with yet another principal feature of my present invention said adjustable stop means are individually electrically adjustable under the control of manually operable adjustment control means which are attached to the body of the user in an easily manually accessible location.

In accordance with another principal feature of my present invention said body member is provided with an upwardly curved toe portion extending forwardly from said central arch portion and with an upwardly curved heel portion extending rearwardly from said central arch portion.

In accordance with yet another principal feature of my present invention a boot binding is secured to the upper face of said arch portion.

In accordance with yet another principal feature of my present invention the periphery of said body member may alternatively take the form of a continuous closed curve having no concavities.

In accordance with a further principal feature of my present invention the periphery of said body member may alternatively take the form of a "bearpaw" snowshoe of well known type.

In accordance with a yet another principal feature of my present invention said now engaging gripper blade means is provided with a plurality of scoops each of which projects from the lower face of said gripper blade means opposite said body member and has an outer opening which lies in a plane substantially perpendicular to said gripper blade means and an inner opening which lies in the plane of said lower face of said gripper blade means.

For a fuller understanding of the nature and objects of my present invention, reference should be had to the following detailed description, taken in connection with the accompanying drawings.

DESCRIPTION OF THE PREFERRED EMBODIMENT

Figure 1:
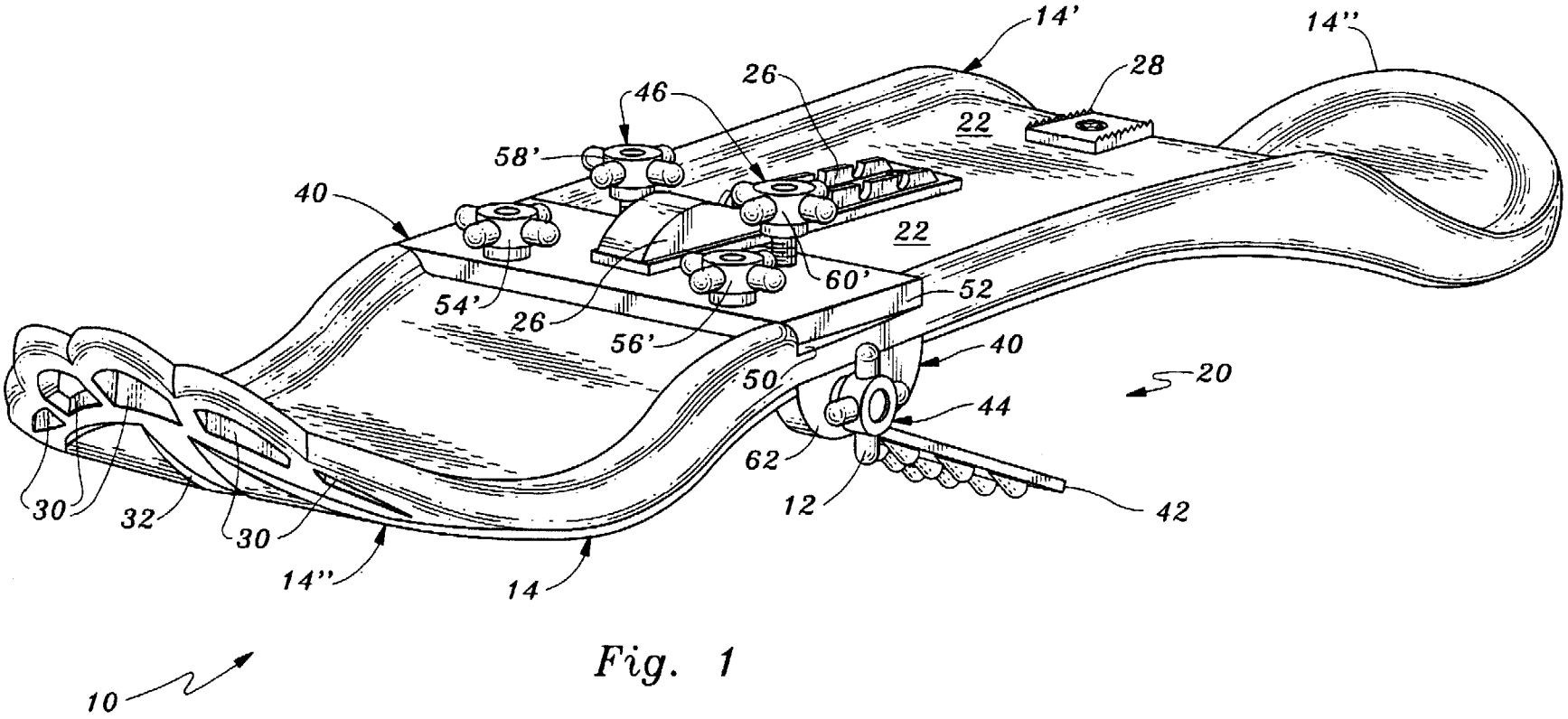
FIG. 1 is a perspective view of a left-hand skishoe of a first preferred embodiment of my present invention.

Referring now to FIG. 1, there is shown a skishoe 10 of the first preferred embodiment of my present invention, sometimes called a "ski-paw", which is adapted for wearing on the user's left foot.

It is to be understood that skishoe 10 is but one of a pair of the skishoes of the first preferred embodiment, the other skishoe 10' of that same pair being a left/right mirror image of skishoe 10.

Figure 2:
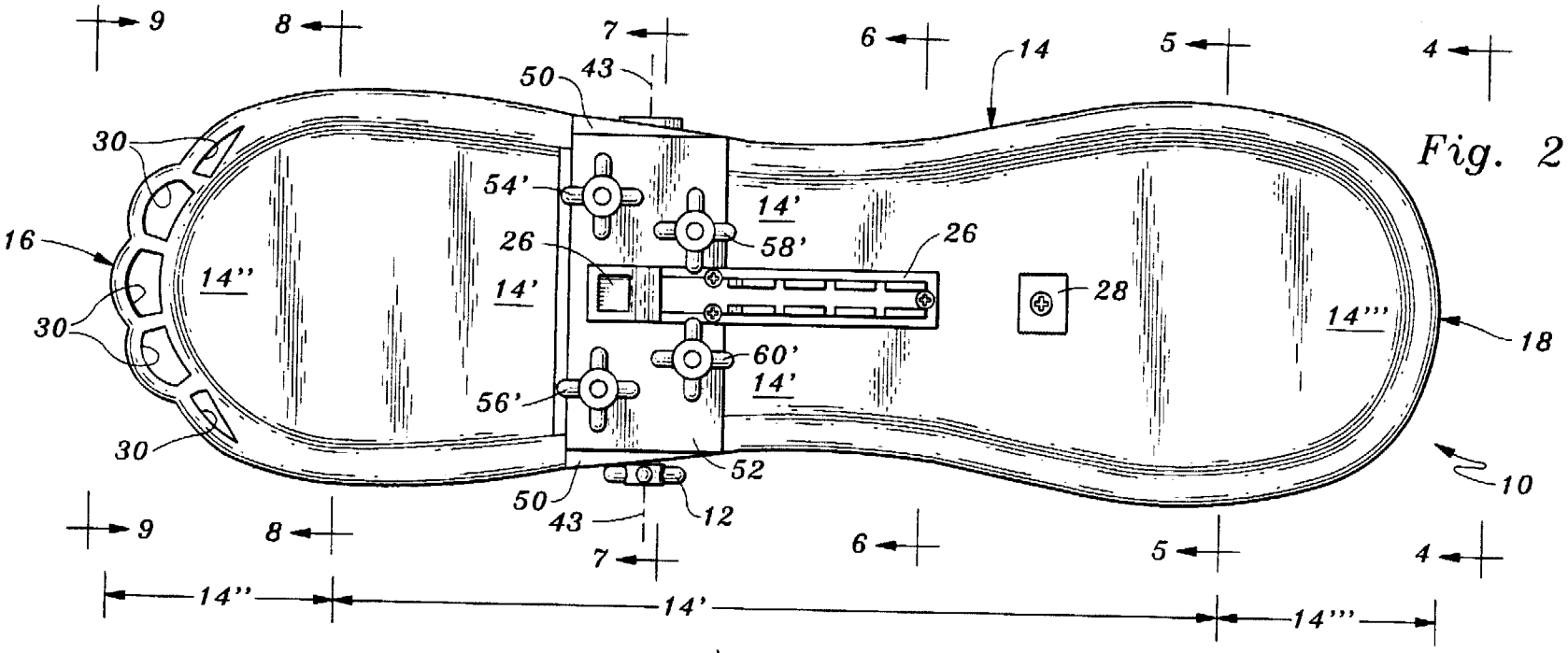
FIG. 2 is a plan view of the skishoe of the first preferred embodiment of my present invention shown in FIG. 1.
Figure 3:
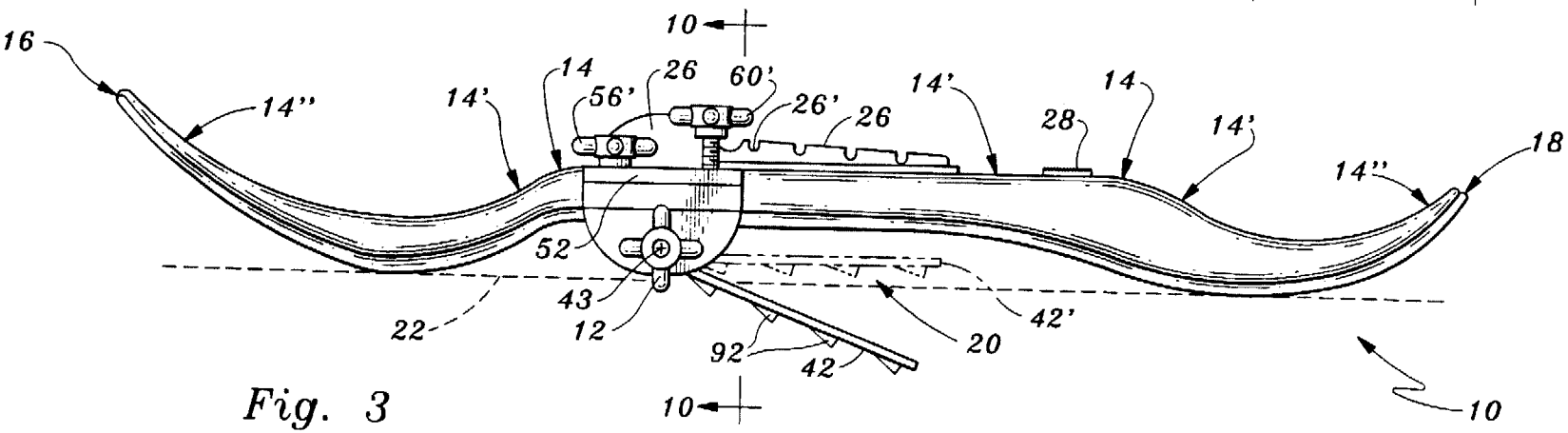
FIG. 3 is an elevation view of a left skishoe body of the first preferred embodiment of my present invention shown in FIGS. 1 and 2.
Figure 4:
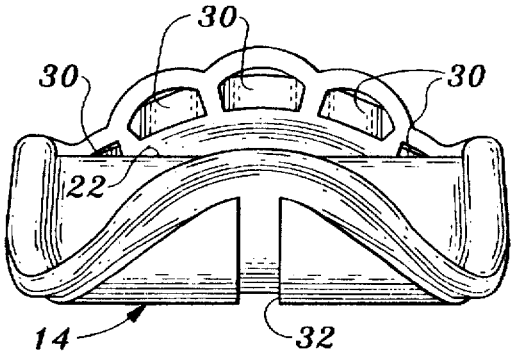
FIG. 4 is a rear view of the skishoe body of the first preferred embodiment of my invention shown in FIGS. 1 and 2, taken on plane 4—4 of FIG. 2.
Figure 5:
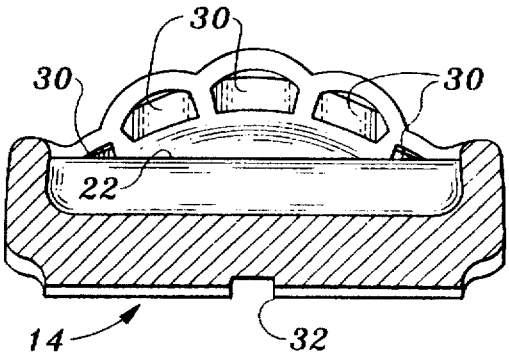
FIG. 5 is a cross-sectional view of the skishoe body of the first preferred embodiment of my present invention shown in FIGS. 1 and 2, taken on plane 5—5 of FIG. 2.
Figure 6:
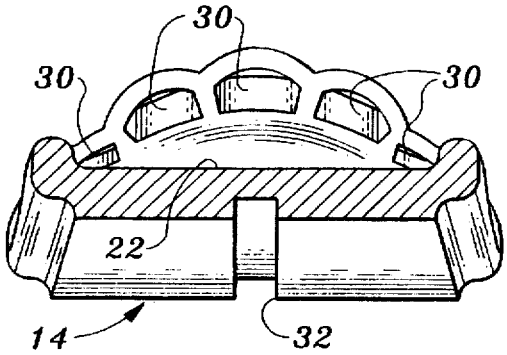
FIG. 6 is a cross-sectional view of the skishoe body of the first preferred embodiment of my present invention shown in FIGS. 1 and 2, taken on plane 6—6 of FIG. 2.

Referring now to FIG. 1, and comparing the same with FIGS. 2 and 3, it will be seen that skishoe body 14, while unitary in construction, may be thought of as being comprised of three portions, viz., the arch portion 14', the toe portion 14", and the heel portion 14'".

As best seen in FIG. 2, arch portion 14' of body 14 extends from cutting plane 8 to cutting plane 5; toe portion 14" extends from forwardmost point 16 of body 14 to cutting plane 8; and heel portion 14'" extends from the rearwardmost point 18 of body 14 to cutting plane 5.

Skishoe body 14 is preferably molded as a single piece from a plastic material of well known type which is of sufficient strength and rigidity so as to remain in substantially the same configuration as that shown in FIGS. 1 through 3 throughout the use of skishoes 10, 10'. In some embodiments body 14 may be somewhat resilient. It is to be understood, however, that my invention is not limited to the employment of any particular material or construction in fabricating body 14. Thus, body 14 may, in certain embodiments of my invention be fabricated from metallic material, e.g., aluminium, or epoxy-bonded fibreglass.

In FIG. 3, it will be seen that arch portion 14' defines, with tangent plane 22, a camber 20.

Referring again to FIG. 1, it will be seen that arch portion 14' has a substantially planar upper face portion 22, to which is affixed a boot anchor 26 and a heel plate 28.

Boot anchor 26 may, for example, and not by way of limitation, be a boot anchor of the type made and sold under the trade designation Rottefella. Heel plate 28 may, by way of example, and not by way of limitation, be a heel plate of the type supplied with the abovesaid Rottefella boot anchor.

As further seen in FIGS. 1, 2 and 4 through 9, a plurality of apertures 30, preferably five in number, pass through toe portion 14" closely adjacent the leading edge thereof.

As seen in FIGS. 1 an 4 through 9, a longitudinal groove 32 is provided in the bottom face of body 14, which extends substantially from end to end of body 14.

Referring now to FIG. 1, it will be seen that an assembly 40 of parts is mounted on body 14 at the forward end of the planar upper surface portion or deck 22 thereof, i.e., the end of the deck 22 adjacent toe portion 14".

For reasons which will become apparent hereinafter, assembly 40 will sometimes be called herein the "gripper brake assembly" or "gripper".

Figure 10:
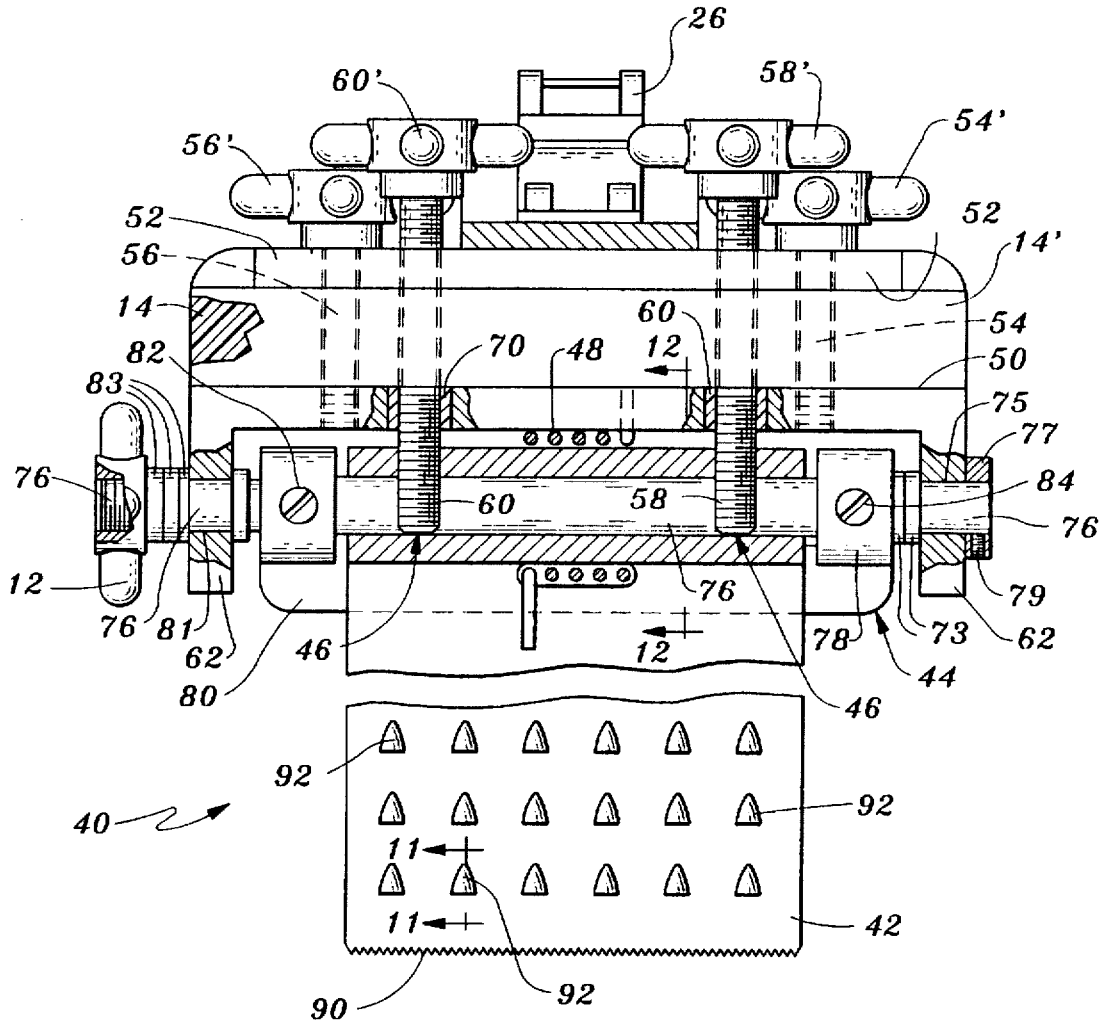
FIG. 10 is a cross-sectional view of the skishoe of the first preferred embodiment of my present invention shown in FIG. 3, taken on plane 10—10 of FIG. 3.

The principal parts of gripper brake assembly 40 and their relationship to body 14 are shown in detail in FIG. 10.

Gripper brake 40 is comprised of a projecting member 42, shown in FIGS. 1, 3 and 10, which is sometimes called the "gripper blade" or "brake blade" herein.

As explained hereinafter in connection with FIGS. 1, 3 and 10, blade 42 is mounted for rotation about an axis 43 (FIGS. 2 and 3), and thus can angularly deflected about axis 43 from its fully retracted position 42', shown in dashed lines in FIG. 3, to any one of a large number of deflected positions, one of which is shown in solid lines in FIG. 3.

As also explained hereinafter, first adjustable extension limit stop means 44 is provided for limiting the deflection of brake blade 42 from its fully retracted position 42' (FIG. 3), and second adjustable retraction limit stop means 46 is provided for limiting the return movement of blade 42 to its fully retracted position 42', i.e., for preventing blade 42 from more closely approaching its fully retracted position (42', FIG. 3) than a selected minimum angle of deflection.

As also seen in FIG. 10, gripper assembly 40 includes a coil spring or deflection spring 48 by means of which blade 42 is resiliently biased against first adjustable blade stop means 44, and thus is maintained in the currently selected one of said deflected positions except when urged from that position, e.g., by the snow over which skishoe 10 is passing.

Referring now to FIGS. 4 through 9, the contours of body 14 are shown in detail. It is to be particularly noted that for clarity of illustration gripper assembly 40, boot binder 26 and heel plate 28 are not shown in FIGS. 4 through 9.

Deck 22 is shown in FIGS. 4 through 7.

Figure 7:
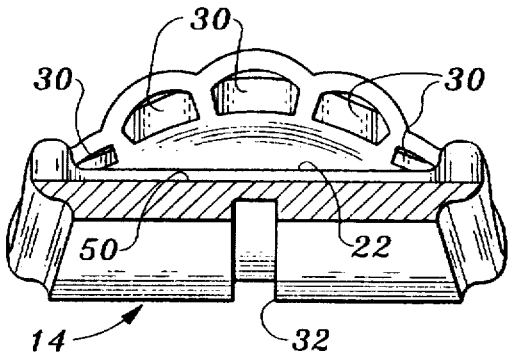
FIG. 7 is a cross-sectional view of the skishoe body of the first preferred embodiment of my present invention shown in FIGS. 1 and 2, taken on plane 7—7 of FIG. 2.
Figure 8:
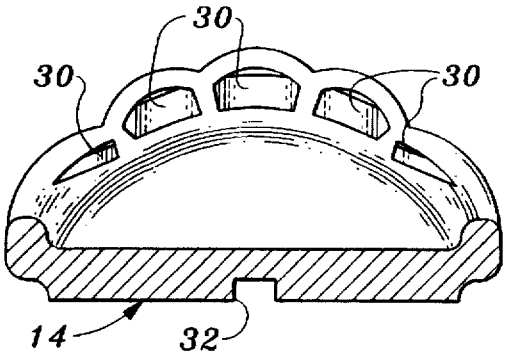
FIG. 8 is a cross-sectional view of the skishoe body of the first preferred embodiment of my present invention shown in FIGS. 1 and 2, taken on plane 8—8 of FIG. 2.
Figure 9:
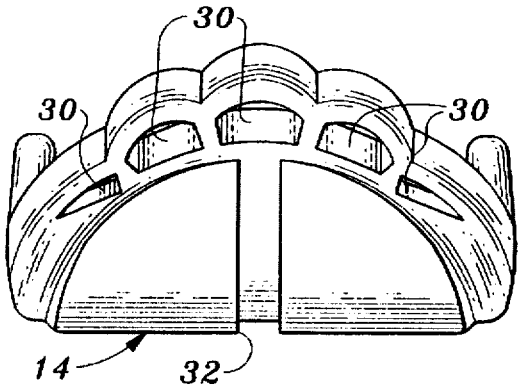
FIG. 9 is a front view of the skishoe body of the first preferred embodiment of my present invention shown in FIGS. 1 and 2, taken on plane 9—9 of FIG. 2.

The portion 50 of body 14 which is recessed below deck 22 and receives the upper bracket 52 of gripper assembly 40 is shown in FIGS. 1, 2, and 7.

Referring now to FIG. 1, it will be seen that the star wheel heads 54', 56', of bolts 54, 56 (FIG. 10) overlie upper bracket 52 of gripper assembly 40 when skishoe 10 is fully assembled.

As also seen in FIG. 1, the star wheel heads 58', 60' of bolts 58, 60 (FIG. 10) overlie upper bracket 52 of gripper assembly 40 when skishoe 10 is fully assembled.

Referring now to FIG. 10, it will be seen that gripper assembly 40 is comprised of upper bracket 52 and lower bracket 62, between which is clamped a portion of body 14, lower bracket 62 bearing against the bottom of arch portion 14' of body 14 and upper bracket 52 bearing against the recessed portion 50 of the upper surface of arch portion 14' of body 14.

As further seen in FIG. 10, bolt 54 passes through a clearance hole in upper bracket 52 and thence through a clearance hole in arch portion 14'. The lower end of bolt 54 is then threadedly received in a tapped hole in lower bracket 62.

When the lower end of bolt 54 is fully engaged with said tapped hole in bracket 62, as shown in FIG. 10, the star wheel head 54' of bolt 54 bears firmly against the upper surface of bracket 52, forcing the lower face of bracket 52 firmly against recessed portion 50 of arch portion 14' of body 14, and the upper surface of lower bracket 62 bears firmly against the lower surface of arch portion 14'.

Similarly, bolt 56 passes through clearance holes in upper bracket 52 and body portion 14' and is threadedly received in a tapped hole in lower bracket 62.

Thus, when bolts 54 and 56 pass through their associated clearance holes in upper bracket 52 and central body portion 14', and when bolts 54 and 56 are threadedly engaged in their corresponding tapped holes in lower bracket 62 and the lower ends of both bolts are fully engaged with their corresponding tapped holes in lower bracket 62, body portion 14 is firmly clamped between upper bracket 52 and lower bracket 62, the lower faces of star wheel bolt heads 54', 56' bearing against the upper face of upper bracket 52.

As further seen in FIG. 10, bolt 58 passes through a clearance hole in upper bracket 52 and portion 14' of body 14, and thence through retainer bushing 68, which is affixed in an aperture in lower bracket 62. Bushing 68 is a retainer bushing of well known type which threadedly receives bolt 58 and frictionally engages it, whereby bolt 58 is prevented from rotating except in response to torque applied to star wheel head 58', and then only with considerable torque applied to head 58'. Thus, the extent of the projection of bolt 58 from the lower face of lower bracket 62 can be varied by the rotation of head 58', with considerable torque, and otherwise the extent of the projection of the lower end of bolt 58 remains unchanged.

Bolt 60 similarly coacts with retainer bushing 70, and thus the extent of the projection of the lower end of bolt 60 from the lower face of lower bracket 62 can be determined by rotation of star wheel head 60' with considerable force.

Thus, it will be obvious to those having ordinary skill in the art, informed by the present disclosure, that bolts 58 and 60, retainer bushings 68, 70, etc., serve as the second adjustable blade stop means 46 referred to hereinabove.

It will also be seen when bolts 58 and 60 are substantially withdrawn, i.e., their projections extending below lower bracket 62 are of a predetermined minimum length, gripper blade 42 can assume its fully retracted position 42' (FIG. 3).

It will also be seen that when bolts 58 and 60 project well below the lower face of lower bracket 62, as shown in FIG. 10, gripper blade 42 is prevented from reaching its fully retracted position 42' (FIG. 3).

It will also be seen that by suitably adjusting bolts 58 and 60 the closest angular position of blade 42 to its fully retracted position which blade 42 may assume can be fixed.

Referring again to FIG. 10 it will be seen that first adjustable blade stop means 44 is irrotatably affixed to a shaft 76 by means of two eyes 78, 80 and associated set screws 82, 84.

Each eye 78, 80 is fixed to stop means 44 by a pair of machine screws which extend through clearance holes in stop means 44 and are received in pairs of threaded bores, one pair in each eye 78, 80.

Thus, when each one of said four machine screws is fully engaged with its corresponding threaded bore in stop means 44, each eye 78, 80 is firmly affixed to stop means 44.

As also seen in FIG. 10, each eye 78, 80 is provided with a set screw 82, 84. Each set screw 82, 84 is received in a tapped bore in an eye 78, 80, the axis of each of which tapped bores intersects the axis of shaft 76; and thus when both of said set screws 82, 84 are tightened against suitable flats on shaft 76, stop 44 is irrotatably affixed to shaft 76.

Thus, it will be seen by those having ordinary skill in the art, informed by the present disclosure, that stop means 44 is affixed to shaft 76 for conjoint rotation therewith at all times.

Referring again to FIG. 10, it will be seen that the right-hand end of shaft 76 extends through a pair of washers 73 and thence through a bore 75 in the right-hand overturned end of bracket 62, and terminates in the central aperture of a retainer 77, wherein it is affixed by means of a set screw 79.

As also seen in FIG. 10, the left-hand end of shaft 76 passes through a bore 81 in the left-hand overturned portion of bracket 62, and thence into a threaded central bore in star wheel 12, the extreme left-hand end of shaft 76 being provided with external threads which coact with the threads in the central bore of star wheel 12 as hereinafter described.

Also seen in FIG. 10 is a lock washer arrangement 83 of well known type which locks shaft 76 in any desired position of rotation. More particularly, shaft 76 may be locked in any desired angular position by (1) directly or indirectly positioning shaft 76 in a desired angular position by manipulating stop 44, and (2) holding stop 44 in this position while rotating star wheel 12 to compress lock washer arrangement 83, and thus to lock shaft 76 in the desired angular position.

Figure 12:
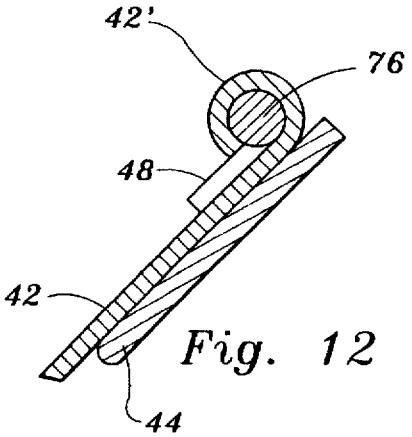
FIG. 12 is a partial cross-sectional view of the gripper blade mechanism of the first preferred embodiment of my present invention shown in FIG. 10, taken on plane 12—12 of FIG. 10.

As may be seen by comparison of FIGS. 10 and 12, blade 42 has a rolled edge 42' (FIG. 12) which close-fittingly embraces shaft 76 in such manner that bade 42 is rotatable about shaft 76.

Thus, it will be seen by those having ordinary skill in the art, informed by the present disclosure, that while stop 44 is lockable in any desired angular position about shaft 76, blade 42 is not directly lockable to shaft 76, but rather is rotatable about shaft 76 in response to the snow over which the skishoe of the present embodiment of the invention is traveling.

Blade 42 is resiliently biased by coil spring 48 into contact with stop 44, and thus assumes the angular position of stop 44, unless blade 42 is rotated out of contact with stop 44, as by snow over which skishoe 10 is traveling.

It should be noted that, in accordance with the principles of my present invention, the star wheel (12') is located on the opposite side of the skishoe body in the right-hand skishoe 10' which corresponds to left-hand skishoe 10 of the first preferred embodiment of my present invention.

Thus, it will be seen by those having ordinary skill in the art, informed by the present disclosure, that blade 42 is resiliently biased outwardly from its fully retracted position (42', FIG. 3) to an outermost position determined by the current setting of first adjustable blade stop means 44, and that blade 42 can be deflected from said outermost position to an innermost position determined by the current setting of second adjustable blade stop means 46 (FIG. 10) by the snow over which skishoe 10 is passing.

As also seen in FIG. 10, blade 42 is provided at its outer end, remote from shaft 76, with serrations 90.

As further seen in FIG. 10, blade 42 is provided with an array of scoops 92.

Figure 11:
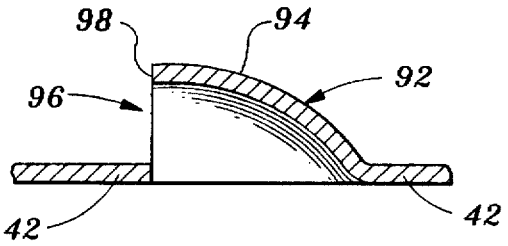
FIG. 11 is a cross-sectional view of one of the scoops of the gripper blade means of the skishoe of the first preferred embodiment of my present invention, taken on plane 11—11 of FIG. 10.

Referring now to FIG. 11, there is shown a cross-section of one scoop 92. As seen in FIG. 11, scoop 92 consists of a body portion 94, which is raised from the surface of blade 42.

As also seen in FIG. 11, body portion 94 includes an opening 96 which is surrounded by an edge of blade 42 and an arcuate lip 98.

Figure 13:
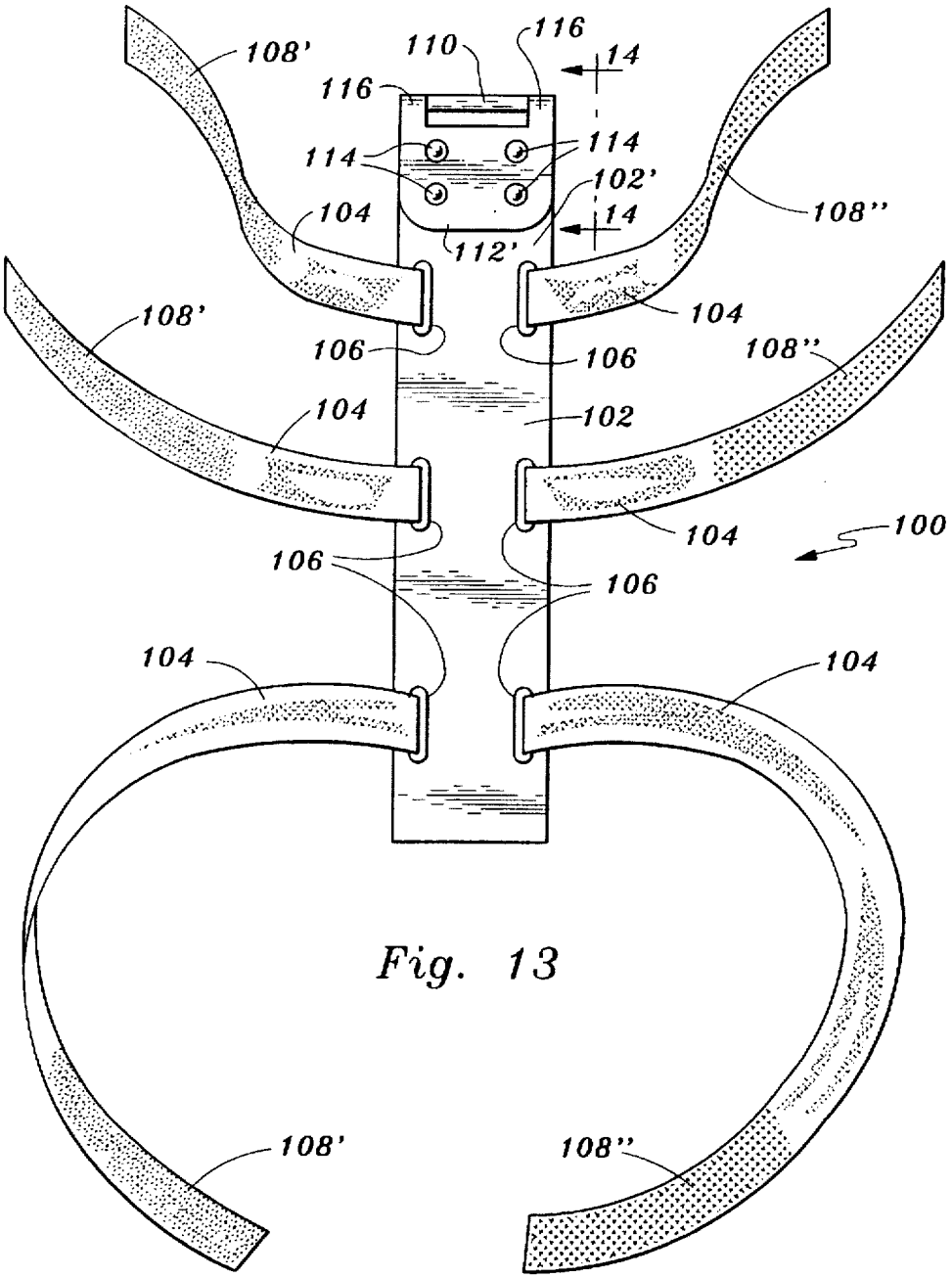
FIG. 13 is a plan view of a boot binder of my present invention as used in the second preferred embodiment of my present invention.
Figure 14:
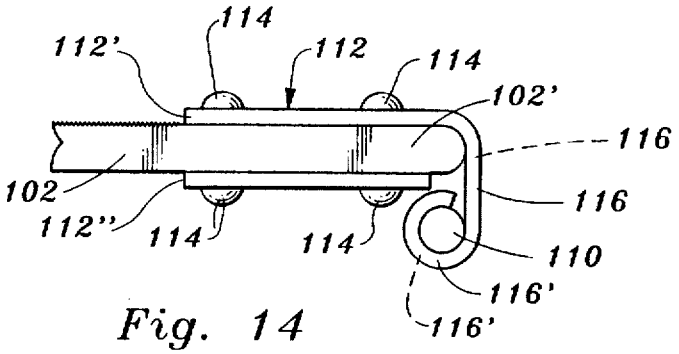
FIG. 14 is a partial elevational view of the boot binder of FIG. 13, taken on plane 14—14 of FIG. 13.

Referring now to FIGS. 13 and 14, there is shown a boot binder 100 of my present invention.

Boot binder 100 is compared of an elongated, substantially rigid spine member 102 and a plurality of straps 104 fabricated from flexuous material such as woven nylon strapping.

Each strap 104 is anchored to spine 102 at its inner end by suitable anchoring means 106 the provision of which is within the scope of those having ordinary skill in the art.

The outer end of each strap 104 is provided with a patch of pileate fastening material of the kind sometimes sold under the trademark VELCRO. The patches indicated by the reference numeral 108' are patches of hook-type material and the patches indicated by the reference numeral 108" are patches of loop-type material.

As may be seen by comparison of FIGS. 13 and 14, a short anchoring rod 110 is affixed to the front end 102' of spine 102 by means of a mounting bracket 112.

Mounting bracket 112 is comprised of an anchor 112' and a reenforcing plate 112".

As best seen in FIG. 14, anchor 112' and reenforcing plate 112" are attached to opposite sides of the front end 102' of spine 102, anchor 112' confronting the upper face of spine 102 and reenforcing plate 112" confronting the lower face of spine 102.

Anchor 112' and reenforcing plate 112" are attached to spine 102 by means of four rivets 114 which pass through spine 102, anchor 112' and reenforcing plate 112", and are suitably headed over in the well known manner to maintain anchor 112' and plate 112" tightly joined to front end 102' of spine 102.

As may be seen by comparison of FIGS. 13 and 14, the forward end of anchor 112' is so shaped as to provide two elongated fingers 116.

As best seen in FIG. 14, both of these fingers 116 are bent downwardly over the front end of spine 102, and then formed into closed loops 116'.

As also seen by comparison of FIGS. 13 and 14 the opposite ends of anchoring rod 110 are captive in loops 116.

Rod 110 may be maintained in loops 116 by frictional engagement therewith, or may be affixed to loops 116, respectively, as by brazing or cementing.

Thus, anchoring rod 110 is seen to be rigidly positioned with respect to spine 102, in the juxtaposition shown in FIGS. 13 and 14.

Anchoring rod 110 is so configured and dimensioned that it can be disposed on the top of boot binder 26 (FIG. 3) with anchoring rod 110 locked in the anchoring means located in the bottom of anchoring slot 26' (FIG. 3).

As will be understood by those having ordinary skill in the art, informed by the present disclosure, each pair of skishoes 10, 10' of the present invention may be fitted with a pair of boot binders 100, 100' (not shown).

After locking boot binder 100 onto boot anchor 26 (FIG. 3) in the manner indicated above, and locking boot binder 110' on the corresponding boot anchor 26 of skishoe 10' in the same manner, the user of skishoes 10, 10' may place his feet on the respective boot binders 100, 100' and then secure his feet, wearing any kind of boot or shoe, to the respective boot binders 100, 100' by lacing straps 104 around his respective feet and then fastening the opposing straps together by means of the pileate fastener material patches 108', 108" affixed thereto.

In particular, the two rear straps 104 (FIG. 3) should be wrapped around the heel of each foot and then fastened together over the instep of that foot.

The middle straps 104 should pass over the instep of the associated foot and then be joined together by the patches of pileate fastening means 108', 108", and the forwardmost pair of straps 104 (FIG. 13) should then be brought together over the toe of the associated foot, and joined together by the patches of pileate fastening material 108', 108".

It will thus be seen that the objects set forth above, among those made apparent from the preceding description, are efficiently attained, and since certain changes may be made in the above constructions without departing from the scope of the present invention, it is intended that all matter contained in the above description or shown in the accompanying drawings shall be interpreted as illustrative only, and not in a limiting sense.

While star wheels 58', 60', and 12 are directly manually adjustable in the preferred embodiment, it is to be understood that the provision of electrical remote control means for adjusting star wheels 58', 60', and 12 is within the scope of my present invention. An example of such electrical remote control means is described hereinbelow in the following description of the second preferred embodiment of my present invention.

THE SECOND PREFERRED EMBODIMENT OF THE PRESENT INVENTION

Referring now to FIGS. 15 through 18, taken with the related portions of the foregoing specification and drawings, the second preferred embodiment of the present invention will now be described.

Figure 15:
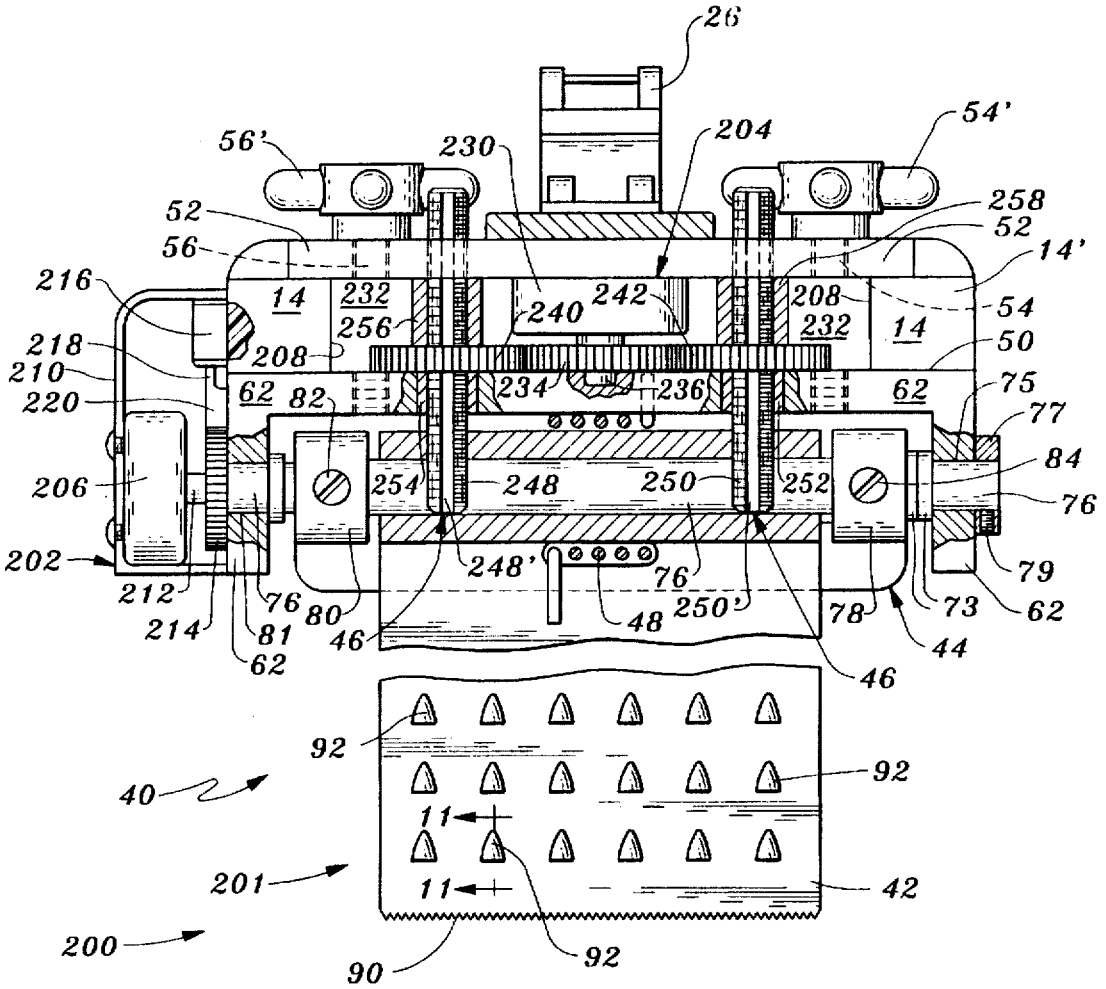
FIG. 15 is a cross-sectional view of a left skishoe of the second preferred embodiment of my present invention as shown in FIG. 16, taken on plane 15–15 of FIG. 16.
Figure 16:
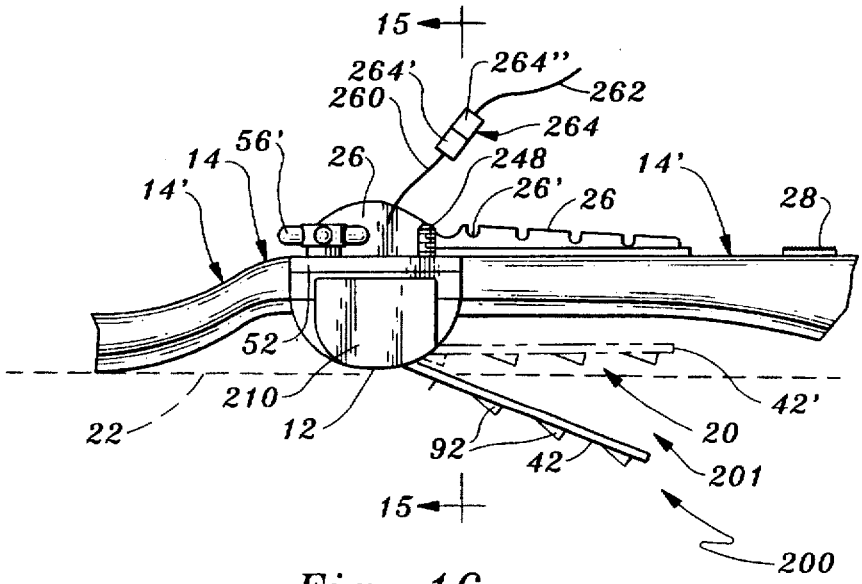
FIG. 16 is a partial elevational view of a left skishoe body of the second preferred embodiment of my present invention.

It is to be noted that FIGS. 15 and 16, like FIGS. 1 through 3 and 10, show only the left one of a pair of skishoes of the present invention. Thus, it will be understood by those having ordinary skill in the art, informed by the present disclosure, that a complete apparatus 200 of the second preferred embodiment of the present invention will include, in addition to the left skishoe shown in FIGS. 15 and 16, a corresponding right skishoe which is in general enantiomorphic, or in mirror image relationship, to the left skishoe of FIGS. 15 and 16.

Figure 17:
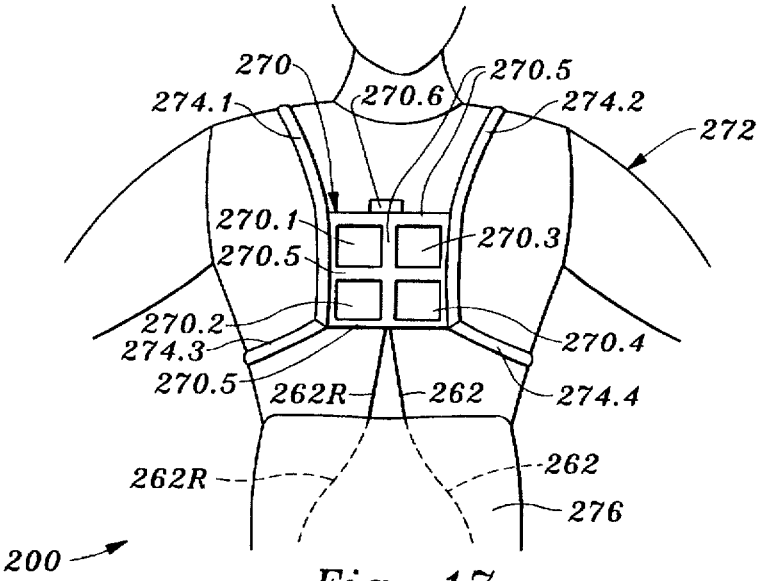
FIG. 17 is a partial front view of the body of a shoeskier wearing the control pack of a pair of skishoes of the second preferred embodiment of my present invention.

It is further to be understood that a complete skishoe apparatus 200 of the second preferred embodiment of the present invention is comprised of (1) a left skishoe 201 as shown in FIGS. 15 and 16, (2) a right skishoe 201R which is generally an enantiomorph of the left skishoe of FIGS. 15 and 16, and (3) a control unit 270 as shown in FIG. 17, including interconnecting cables 262 and 262R.

Figure 18:
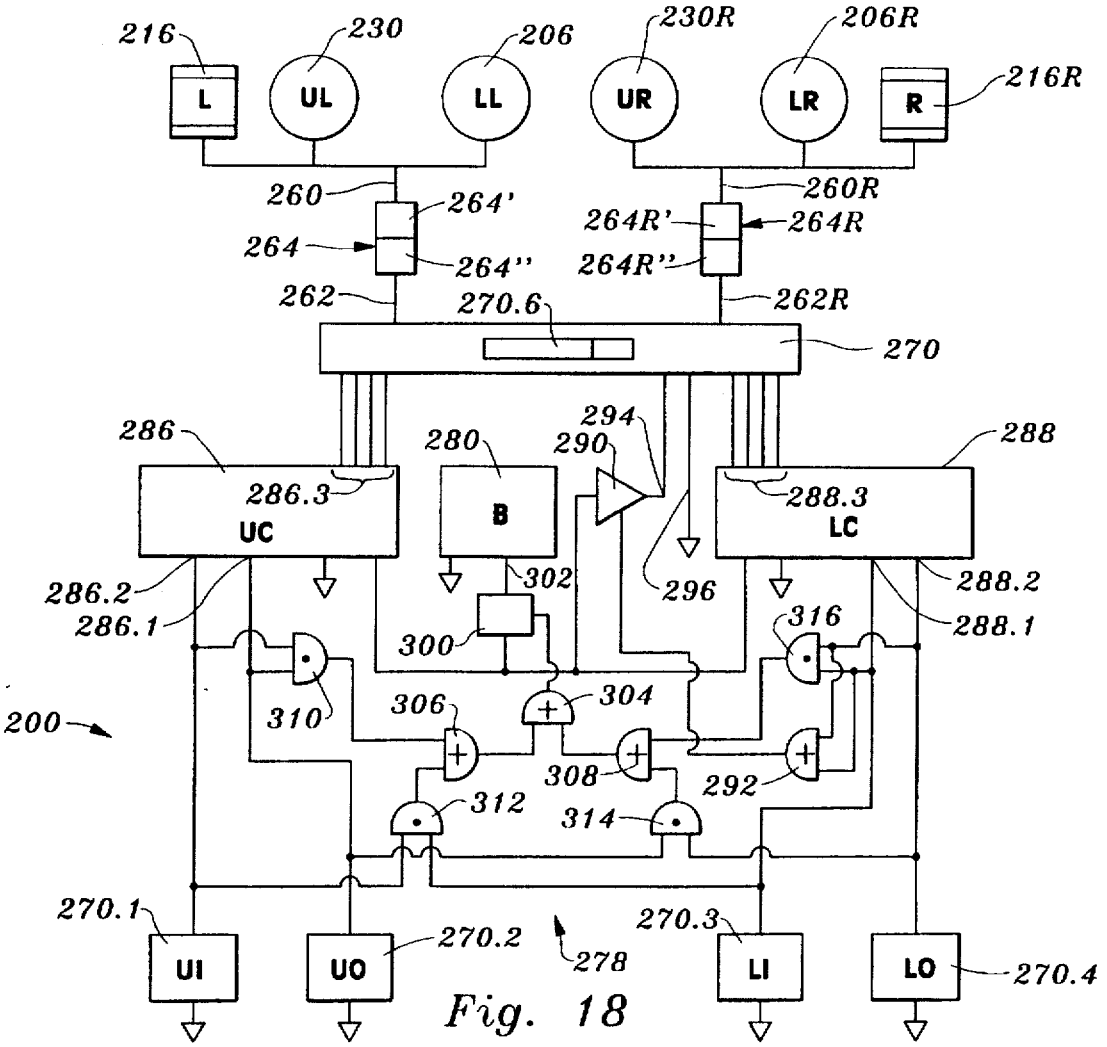
FIG. 18 is a schematic block diagram of the electrical system of the second preferred embodiment of my present invention.

FIG. 18 schematically represents the electrical remote control means or stop control system of the second preferred embodiment of the present invention.

With respect to FIGS. 15 and 16, it is to be understood that the parts shown therein which are common with or substantially identical to corresponding parts of the first preferred embodiment are designated by the same reference numerals which are used to designate the same parts of the first preferred embodiment.

It is also to be understood that the parts of the second preferred embodiment shown in FIGS. 15 and 16 which do not correspond to any part of the first preferred embodiment are designated by reference numerals the numerical values of which are greater than 200.

Referring now to FIGS. 15 and 16, it will be seen that the left skishoe of the apparatus 200 of the second preferred embodiment of the present invention is designated herein by the reference numeral 201. Correspondingly the right skishoe of the apparatus of the second preferred embodiment of the present invention is designated herein by the reference numeral 201R. Every part of a right skishoe of the invention is designated herein by the reference number of the corresponding part of the left skishoe, followed by the suffix R.

Comparing FIGS. 15 and 16 with FIGS. 3 and 10, it will be seen that starwheels 12, 58' and 60' have been replaced by an electrical drive system.

As will be explained in detail hereinafter, a stepping motor 206 (FIG. 15) serves to selectively position shaft 76 about its axis, and thus to selectively angularly position lower stop 44 about the axis of shaft 76.

It is to be noted that when stop 44 is moved from one angular position to another angular position by means of stepping motor 206 skishoe 201 should be so positioned that stop 44 is held in or near its home position 42' (FIG. 16) by the supporting snow.

It is also to be noted that stop means 46 (threaded shafts 248 and 250) should be operated by remote control only when stop 44 is so far out from its home position that stop means 46 does not operate against brake blade 42.

Referring now to FIG. 15, it will be seen that stepping motor 206 is mounted in a rigid housing 210.

As seen in FIGS. 15 and 16, rigid housing 210 is affixed to the left side of skishoe body 14 and to the left side of lower bracket 62, and thus drive motor 206 is fixedly positioned with respect to body 14 and bracket 62 with the axis of its output shaft 212 aligned with the axis of shaft 76.

Output shaft 212 is fixed in a socket provided in the end of shaft 76, and thus output shaft 212 and shaft 76 are mutually affixed to each other for joint rotation, i.e., are mutually irrotatably joined together.

As seen in FIG. 15, a gear 214 is mounted on output shaft 212 of stepping motor 206. Gear 214 is irrotatably affixed to output shaft 212 and thus is jointly rotatable therewith and not otherwise rotatable.

Also contained in housing 210, and affixed to body 214, is a solenoid 216.

The armature 218 of solenoid 216 is provided at its outer end with a blade 220 which is adapted to engage with the teeth of detenting gear 214. Two guides (not shown) are provided for maintaining blade 220 in a plane containing the axis of motor shaft 212, but at the same time allowing blade 220 and armature 218 to freely move vertically in response to the urgings of the magnetic field produced by the coil of solenoid 216, when energized, and to the force of the return spring of solenoid 216.

As explained hereinafter, blade 220 is normally maintained in engagement with teeth of detent gear 214 by the action of the return spring of solenoid 216, and is drawn out of engagement with gear 214 by the magnetic field produced by the coil of solenoid 216 only when stepping motor 206 is energized.

Thus, it will be seen that solenoid 216, its associated detenting blade 220 and gear 214 serve to maintain shaft 6 and brake blade 42 in any selected angular position; and to release shaft 76 and brake blade 42 for rotation about the axis of shaft 76 only when stepping motor 206 is energized.

Referring again to FIG. 15, it will be seen that a second stepping motor 230 is located in a chamber 232 in skishoe 201 defined by the walls of an opening 208 in skishoe body 14, the upper face of lower bracket 62, and the lower face of upper bracket 52 and the parts of skishoe 201 to which it is affixed, directly or indirectly.

The main body or stator of stepping motor 230 is affixed to upper bracket 52 and thus is not rotatable with respect to upper bracket 52.

As further seen in FIG. 15, a central gear 234 is mounted on an irrotatably affixed to the shaft 236 of stepping motor 230.

As also seen in FIG. 15, each one of a pair of gears 240, 242 is permanently meshed with central gear 234.

Further, gear 240 is longitudinally, slidably mounted on a threaded shaft 248 and gear 242 is longitudinally, slidably mounted on a threaded shaft 250.

Threaded shaft 248 passes through and is engaged with an internally threaded bushing 254 which is itself fixedly mounted in an aperture in lower bracket 62. Internally threaded shaft 248 also passes through a clearance hole in upper bracket 52. Threaded bushing 254 is not a retainer bushing, but rather allows the free rotation of threaded shaft 248.

Similarly, threaded shaft 250 passes through an is engaged with an internally threaded bushing 252 which is itself fixedly mounted in an aperture in lower bracket 62. Threaded shaft 250 also passes through a clearance hole in upper bracket 52. Internally threaded bushing 250 is not a retainer bushing, but rather allows the free rotation of threaded shaft 250.

As also seen in FIG. 15, threaded shaft 248 is provided with a keyway 248', and threaded shaft 250 is provided with a keyway 250'. Threaded shaft 248 is also provided with a second keyway 248", which is located on the opposite side of threaded shaft 248; and threaded shaft 250 is provided with a second keyway 250", which is located on the opposite side of threaded shaft 250. The aperture within gear 240 which receives threaded shaft 248 is provided with a pair of inwardly projecting ears of keys which are permanently engaged with keyways 248' and 248", respectively.

Similarly, the aperture within gear 242 which receives threaded shaft 250 is provided with a pair of inwardly projecting ears or keys which are engaged with keyways 250' and 250", respectively.

Thus, it will be seen that when gear 240 rotates through a particular angle its associated threaded shaft 248 is turned through the same angle of rotation about its own axis. This rotation of threaded shaft 248 (which is engaged in threaded bushing 254) causes threaded shaft 248 to correspondingly move upwardly or downwardly (as seen in FIG. 15), depending upon the direction or sense of rotation of gear 240 (clockwise or counterclockwise).

Similarly, threaded shaft 250 moves upwardly or downwardly when gear 242 is rotated in the clockwise or counterclockwise direction or sense.

As will now be evident to those having ordinary skill in the art, informed by the present disclosure, shafts 248 and 250 move downwardly in unison when the shaft 236 of stepping motor 230 rotates in a first direction, and shafts 248 and 250 move upwardly in unison when the shaft 236 of stepping motor 230 rotates in a second (opposite) direction.

It is to be noted that axial movement of gear 240 is prevented by the interposition of a sleeve 256, and that axial movement of gear 242 is prevented by the interposition of a sleeve 258.

Referring now to FIG. 16, it will be seen that a multi-conductor cable 260 emerges from the upper face of upper bracket 52. It will also be seen that a multi-conductor cable 262, which is an extension of cable 260, is coupled to cable 260 by means of a multi-conductor connector 264. It is to be understood that the two parts 264', 264" of connector 264 are frictionally joined, and not mechanically locked together.

It is further to be understood that cable 260 is connected to separate, mutually-insulated lead wires located within skishoe 201, and that thus the voltages for energizing stepping motors 206 and 230 are supplied via cable 260 and its associated lead wires; cable 260 deriving these voltages from cable 262, which is itself connected to the electrical control pack 270 shown in FIG. 17 and discussed hereinbelow in connection therewith.

It is further to be understood that solenoid 216 is also energized from control pack 270 via cables 262, 260, connector 264, etc.

Referring now to FIG. 17, it will be seen that control pack 270 is worn by the user 272 of the device 200 of the second preferred embodiment of the present invention. User 272, as seen in FIG. 17, is clad in typical skiing or snowshoeing apparel, and control pack 270 is maintained in contact with the chest-overlying portion thereof by means of a suitable harness of straps 274.1, 274.2, 274.3, 274.4., etc. The problem of such harness is well within the scope of those having ordinary skill i the ski and snowshoe equipment art, and will not be discussed in detail in the present specification.

As also seen in FIG. 17, the end of cable 262 remote from the end thereof shown in FIG. 16 extends outwardly from control pack 270. After passing downwardly over the diaphragm area of user 272, cable 262 is passed into the waist opening of the pants 276 worn by user 272, and thence extends downwardly through the interior of the left leg of pants 276 to the foot opening thereof. Cable 262 then passes outwardly through that foot opening, terminating in connector part 264" (FIG. 16), which is located a short distance outside that foot opening.

Also shown in FIG. 17 is a similar cable 262R which extends outwardly from control pack 270. After passing downwardly over the diaphragm area of user 272, cable 262R is passed into the waist opening of the pants 276 worn by user 272, and thence extends downwardly through the interior of the right leg of pants 276 to the foot opening thereof, and thence outwardly through that foot opening, terminating in a connector part 264R" which is generally enantiomorphic to connector part 264" (FIG. 16).

Thus, it will be seen that when control pack 270 has been properly donned by user 272 cable 262 will extend a short distance out of the left leg opening of pants 276, terminating in connector part 264"; and that cable 262R will extend a similar short distance out of the right leg opening of pants 276, terminating in a connector part 264R".

It is further to be understood that when user 272 attached his or her boots to the boot clamps of left skishoe 201 and right skishoe 201R, respectively, he or she also interconnects connector parts 264' and 264", and further interconnects connector parts 264' and 264R".

Thus, it will be seen by those having ordinary skill in the art, informed by the present disclosure, that when the complete skishoe apparatus 200 of the second preferred embodiment of the present invention is properly donned by user 272 the electrical circuit 278 thereof is completely interconnected, as shown in FIG. 18.

In the second preferred embodiment of the present invention the amount of slack provided by the part of cable 262 which extends beyond the foot opening of the left leg of pants 276 is sufficient to accommodate the full range of movement of the user's left boot in the boot clamp of skishoe 201.

Similarly, in the second preferred embodiment of the present invention, the amount of slack provided by the part of cable 262R which extends beyond the foot opening of the right leg of pants 276 is sufficient to accommodate the full range of movement of the user's right boot in the boot clamp of skishoe 201R.

It may be found desirable in some embodiments of the present invention to incorporate connector part 264" into the user's left boot, and to incorporate connector portion 264' into an immediately adjacent portion of the associated left boot clamp; and to do the same with connector parts 264R" and 264R' and their respective associated right boot and right boot clamp.

Further, it may be fond desirable in some embodiments of the present invention to provide wireless rather than wired connecting links between the control packs of those embodiments and the respective skishoes of those embodiments, and all such modifications are to be understood to fall within the scope of the present invention.

It is also to be noted that the parts 264 ' and 264" of connector 264, when interconnected, are frictionally interengaged but are not mechanically interlocked; and further that the parts 264R' and 264R" of connector 264R, when interconnected, are frictionally interengaged, but are not mechanically interlocked. Thus, it will be seen by those having oridnary skill in the art, informed by the present disclosure, that the parts 264"and 264" of connector 264 can be readily disengaged from each other in the event that, in an emergency, it is desirable to quickly disengge them, and that the parts 264R' and 264R" of connector 264R can be readily disengaged from each other in the event that, in an emergency, it is desirable to quickly disengage them.

In accordance with a principle feature of the present invention the frictional interengagement of the parts of the respective connectors 264, 264R is made sufficiently slight so that the forces necessary to disengage their parts from each other will spontaneously occur in emergency situations, and thus it will not be necessary to manually disengage the parts of connectors 264 and 264R from each other in emergency situations.

Referring again to FIG. 17, it will be seen that four depressible switch panels 270.1, 270.2, 270.3 and 270.4, are provided on the outer face of control pack 270, and that a slide switch 270.6 is provided on the upper edge of control pack 270.

As explained hereinafter, depressible switch panels 270.1, 270.2, 270.3 and 270.4 and slide switch 270.6 are the manually operable control means whereby user 272 can manually control the operation of stepping motors 206, 206R, 230 and 230R, and solenoids 216 and 216R, and thus can control the positioning of stop means 44 and 44R, and stop means 46 and 46R, of the second preferred embodiment of the present invention.

As also explained hereinafter, depressible switch panels 270.1, 270.2, 270.3 and 270.4 control the operation of the stepping motors and the solenoid of one selected skishoe at a time, and the setting (left or right) of slide switch 270.6 determines which skishoe (left or right) is thus selected.

Referring now to FIG. 18, the electrical circuit 278 of the complete skishoe apparatus 200 of the second preferred embodiment of the present invention is schematically represented in block diagram form.

As seen in FIG. 18, the circular symbol containing the legend UL represents stepping motor 230 (FIG. 15). The legend UL indicates that the stop operated by stepping motor 230 is the upper (U) stop 46, i.e., the threaded shafts 248, 250, of left (L) skishoe 201.

As also seen in FIG. 18, the circular symbol containing the legend UR represents stepping motor 230R. The legend UR indicates that the stop operated by stepping motor 230R is the upper (U) stop 46R, i.e., the threaded shafts 248R, 250R, of right (R) skishoe 201R.

The circular symbol containing the legend LL shown in FIG. 18 represents stepping motor 206 (FIG. 15). The legend LL indicates that the stop operated by stepping motor 206 is the lower (first L) stop 44 of the left (second L) skishoe 201.

The circular symbol containing the legend LR shown in FIG. 18 represents stepping motor 206R. The legend LR indicates that the stop operated by stepping motor 206R is the lower (L) stop 44R of the right (R) skishoe 201R.

The rectangular symbol shown in FIG. 18 which contains the legend L represents detenting solenoid 216 of the left skishoe 201 of the second preferred embodiment of the present invention (FIG. 15).

The rectangular symbol shown in FIG. 18 which contains the legend R represents detenting solenoid 216R of the right skishoe 201R of the second preferred embodiment of the present invention.

The rectangular symbol 280 is shown in FIG. 18 which contains the legend B represents a battery pack 280, which provides electrical power for operating stepping motors 230, 206, 230R, 206R and for operating detenting solenoids 216 an 216R, and in general for supplying all of the power requirements of electrical stop positioning circuit 278. While battery pack 280 may be incorporated into control pack 270 (FIG. 17), it is to be understood that the same or a compatible battery pack may be juxtaposed to the back of user 272 and there supported by additional strap means joined to portions of the straps 274.1, 274.2, 274.3 and 274.4 which confront the user's back, in order to provide optimum body balance for user 272, all within the scope of those having ordinary skill in the art.

The four rectangles 270.1, 270.2, 270.3 and 270.4 which are distributed across the lower portion of FIG. 18 represent respectively the depressible switch panels 270.1, 270.2, 270.3 and 270.4 shown in FIG. 17.

Control pack 270 is provided with a front face panel 270.5 through which four shallow wells 270.1', 270.2', 270.3', and 270.4' open; each well extending from front face panel 270.5 into the interior of control pack 270.

Each depressible switch panel 270.1, 270.2, 270.3, 270.4 is captive in its associated well 270.1', 270.2', 270.3', 270.4', by overhanging flanges.

Spring means are provided for resiliently biasing each panel 270.1, 270.2, 270.3, 270.4 outwardly, as shown in FIG. 17, against its associated flange or flanges.

Thus, it will be seen by those having ordinary skill in the art, informed by the present disclosure, that each depressible panel 270.1, 270.2, 270.3, 270.4 normally projects slightly outwardly from its associated well 270.1', 270.2', 270.3', 270.4' to the maximum extent permitted by its associated flange or flanges, and can be manually depressed into its associated well, but will return to its outward position as soon as the manual depressing force is discontinued.

A snap-action switch is located in each such well in predetermined juxtaposition to and for operation by the depressible panel 270.1, 270.2, 270.3, 270.4 located in that well. In the second preferred embodiment each such switch (270.1", 270.2", 270.3", 270.4") can be closed by depressing the associated panel 270.1, 270.2, 270.3, 270.4, and is open when its associated panel is not depressed.

In FIG. 18 the rectangular symbol (270.1) containing the legend UI represents the manually depressible switch panel 270.1 which, when depressed, causes the upper (U) stop 46 or 46R currently selected by means of slide switch 270.6 to move inward (I), i.e., causes the lower ends of threaded shafts 248 and 250 (or 248R and 250R) to move into, or further into, camber 20 or 20R of skishoe body 14 or 14R of the skishoe currently selected by means of slide switch 270.6.

In FIG. 18 the rectangular symbol (270.2) containing the legend UO represents the manually depressible switch panel 270.2, which, when depressed, causes the upper (U) stop 46 or 46R currently selected by means of slide switch 270.6to move outward (O), i.e., causes the lower end of threaded shafts 248 and 250 (or 248R and 250R) to move outwardly, away from skishoe body 14 (or 14R), and thus outward from camber 20 or 20R of skishoe body 14 or 14R of the skishoe currently selected by means of slide switch 270.6.

In FIG. 18 the rectangular symbol containing the legend LI (270.3) represents the manually depressible switch panel 270.3 which, when depressed, causes the lower (L) stop 44 or 44R currently selected by means of slide switch 270.6 to so rotate about the axis of shaft 76 or 76R that its outer edge, remote from that axis, moves toward the skishoe body 14 or 14R currently selected by means of slide switch 270.6, and thus into (I) the camber 20 or 20R of the skishoe body 14 or 14R of the skishoe currently selected by means of slide switch 270.6.

In FIG. 18 the rectangular symbol (270.4) containing the legend LO represents the manually depressible switch panel 270.4 which, when depressed, causes the lower (L) stop 44 or 44R currently selected by means of slide switch 270.6 to so rotate about the axis of shaft 76 or 76R that its outer edge, remote from that axis, moves away from the skishoe body 14 of 14R currently selected by means of slide switch 270.6, and thus to move outwardly from (O) the chamber 20 or 20R of the skishoe body 14 or 14R of the skishoe currently selected by means of slide switch 207.6.

As seen in FIG. 18, electric stop positioning circuit 278 is further comprised of a first stepping motor controller 286 of well known type which is represented by the rectangular symbol containing the legend UC. The legend UC indicates that stepping motor controller 286 controls the operation of the stepping motor 230 or 230R which positions the upper stop (46 or 46R) of the skishoe (14 or 14R) currently selected by slide switch 270.6.

As further seen in FIG. 18, electric stop positioning circuit 278 is yet further comprised of a stepping motor controller 288 of well known type which is represented by the rectangular symbol containing the legend LC. The legend LC indicates that stepping motor controller 288 controls the operation of the stepping motor 206 or 206R which positions the lower stop (44 or 44R) of the skishoe currently selected by slide switch 270.6.

As seen in FIG. 17, switches 270.1 and 270.2 are respectively directly connected to the forward and reverse input terminals 286.1 and 286.2 of stepping motor controller 286. Stepping motor controller 286 is also provided with four stepping motor power supplying output terminals collectively designated by the reference numeral 286.3 for supplying exciting voltage to either stepping motor 230 or stepping motor 230R, depending upon the current setting of skishoe selection switch 270.6.

As also seen in FIG. 18, switches 270.3 and 270.4 are respectively directly connected to the forward and reverse input terminals 288.1 and 288.2 of stepping motor controller 288. Stepping motor controller 288 is also provided with four stepping motor power supplying output terminals collectively designated by the reference numeral 288.3, for supplying exciting voltage to either stepping motor 206 or 206R, depending upon the current setting of skishoe selection switch 270.6.

An integrated circuit amplifier 290 (FIG. 18) supplied by battery pack 280 and controlled by the output signal of OR gate 292 provides at its output terminal 294 a voltage suitable for operating either solenoid 216 or solenoid 216R, depending upon the current setting of slide switch 270.6.

As will be evident to those having ordinary skill in the art, informed by the present disclosure, OR gate 292 is so interconnected with switches 270.3 and 270.4 that the currently selected solenoid 216 or 216R is energized only when at least one of these switches is depressed (closed). A ground terminal 296 is provided for the return conductor of the currently selected detenting solenoid (216 or 216R) energizing circuit.

As also seen in FIG. 18, a solid state switch 300 is directly connected to output terminal 302 of battery pack 280. The operation of solid state switch 300 is controlled by an input signal supplied by OR gate 304. The input signals to OR gate 304 are supplied by OR gates 306 and 308, the input signals of which are supplied by four AND gates 310, 312, 314, 316. Each of these four AND gates compares the output signals derived from a corresponding unique pair of the switches 270.1, 270.2, 270.3, 270.4.

Thus, as will be evident to those having ordinary skill in the art, informed by the present disclosure, the gate network just described serves to open solid state switch 300 whenever more than one of the switches 270.1, 270.2, 270.3, 270.4 are closed, preventing inappropriate energization of the stepping motors 206, 230, 206R, 230R and the solenoids 216 and 216R by accidental simultaneous depression of more than one of the depressible panel switches 270.1, 270.2, 270.3, 270.4.

Referring again to FIG. 18, it will be seen those having ordinary skill in the art, informed by the present disclosure, that cables 262 and 262R both contain ten conductors, corresponding to the four UC terminals 286.3, the detenting solenoid voltage supply terminal 294, the detenting solenoid ground terminal 296, and the four LC terminals, 283.3.

It will further be evident to those having ordinary skill in the art, informed by the present disclosure, that slide switch 270.6 serves to alternatively connect the eight stepping motor control terminals 286.3 and 288.3 and the detenting solenoid supply and ground terminals 294 and 296 either to the ten conductors of cable 262 or to the ten conductors of cable 262R. Thus, it will be seen that, depending upon the position of slide switch 270.6, stepping motor controller terminals 286.3 are operatively connected to the terminals of stepping motor 230 or to the terminals of stepping motor 230R; stepping motor controller terminals 288.3 are operatively connected to the terminals of stepping motor 206 or to the terminals of stepping motor 206R, and detenting solenoid terminals 294, 296 are operatively connected to the terminals of solenoid 216 to the terminals of solenoid 216R.

It will thus be evident to those having ordinary skill in the art, informed by the present disclosure, that user 272 can reset the upper and lower stops of either of his skishoes 201 or 201R by (1) positioning slide switch 270.6 to its position corresponding to the selected skishoe, (2) depressing panel 270.1 or 270.2 to correspondingly move upper stop 46 (or (46R) inwardly or outwardly, and (3) depressing panel 270.3 or 270.4 to corresponding move the outer edge of lower stop 44 (or 44R) inwardly or outwardly of the chamber of the associated skishoe body.

It is also to be understood that the following claims are intended to cover all of the generic and specific features of the invention hereindescribed, and all statements of the scope of the invention which, as a matter of language, might be said to fall therebetween.

What is claimed is:

1. Skishoe apparatus including a left skishoe, a right skishoe and remote control means:

each of said skishoes comprising:

a body member having an upper face and a lower, snow-contacting face opposed thereto;

snow-engaging brake blade means pivotably mounted for pivoting about a pivot axis which extends transversely of said body member;

resiliently biasing means for pivotally biasing said brake blade means about said pivot axis and thus resiliently biasing the end of said brake blade means remote from said pivot axis downwardly from said body member;

adjustable projection stop means for adjustably limiting the downward projection of said end of said brake blade means from said body member;

adjustable retraction limit stop means for adjustably limiting the retraction of said end of said brake blade means toward said body member;

first motive means for adjusting the position of said projection limit stop means with respect to said body member; and second motive means for adjusting the position of said retraction limit stop means with respect to said body member;

said remote control means comprising:

energizing means for selectively energizing said motive means; and manually operable control means for controlling said energizing means.

2. Skishoe apparatus as claimed in claim 1, further comprising attaching means for attaching said manually operable control means to the user of said skishoe apparatus at a location which is accessible to a hand of said user when said user is wearing said skishoes.

3. Skishoe apparatus as claimed in claim 2 wherein said location of said manually operable control means is the chest area of said user.

4. Skishoe apparatus as claimed in claim 2 in which said remote control means and said skishoes are interconnected by means of cables having connectors which are located adjacent the feet of said user.

5. Skishoe apparatus as claimed in claim 4 wherein said location of said manually operable control means is the chest area of said user.

6. Skishoe apparatus as claimed in claim 4 in which said connectors are maintained in contact only by friction between parts thereof.

7. Skishoe apparatus as claimed in claim 2 in which said remote control means includes means for preventing the energization of said motive means when a plurality of said manually operable control means are simultaneously actuated.

8. Skishoe apparatus as claimed in claim 5 wherein said location of said manually operable control means is the chest area of said user.

9. Skishoe apparatus as claimed in claim 2 in which said manually operable control means includes means for manually preselecting the skishoe whose limit stops are to be adjusted in response to manual operation of other ones of said manually operable control mean.

10. Skishoe apparatus as claimed in claim 6 wherein said location of said manually operable control means is the chest area of said user.

* * * * *